US007631778B2

(12) United States Patent
Yoshiyama

(10) Patent No.: US 7,631,778 B2
(45) Date of Patent: Dec. 15, 2009

(54) BUCKLE FOR THIN PLATE STORAGE CONTAINER AND THIN PLATE STORAGE CONTAINER

(75) Inventor: Seiji Yoshiyama, Kikuchi (JP)

(73) Assignee: Miraial Co., Ltd. (JP)

( * ) Notice: Subject to any disclaimer, the term of this patent is extended or adjusted under 35 U.S.C. 154(b) by 475 days.

(21) Appl. No.: 11/395,544

(22) Filed: Apr. 3, 2006

(65) Prior Publication Data

US 2007/0228037 A1 Oct. 4, 2007

(30) Foreign Application Priority Data

Mar. 30, 2006 (JP) ..... 2006-095396

(51) Int. Cl.
*B65D 45/16* (2006.01)

(52) U.S. Cl. ..... 220/326; 220/4.24; 206/1.5; 206/710; 206/711; 292/24; 292/116; 292/117

(58) Field of Classification Search ..... 206/1.5, 206/710, 711; 220/4.21, 4.22, 4.24, 315, 220/324, 326; 292/24, 25, 28, 95, 116, 117
See application file for complete search history.

(56) References Cited

U.S. PATENT DOCUMENTS 5,590,444 A * 1/1997 Krauss ..... 24/625
5,921,422 A * 7/1999 Hunter et al. ..... 220/4.02

* cited by examiner

*Primary Examiner*—Anthony Stashick
*Assistant Examiner*—Elizabeth Volz
(74) *Attorney, Agent, or Firm*—Bacon & Thomas, PLLC

(57) ABSTRACT

A buckle serves to fix together a lower container part and an upper container part of a thin plate storage container. The buckle includes a plate-shaped main body, an upper hook having a groove engaged with a locking plate of the upper container part, a lower hook having a groove engaged with a locking plate of the lower container part, spring mounting recesses formed at center positions of the upper hook and the lower hook, leaf springs which are fitted in the spring mounting recesses, and locking protrusions at the middle of the leaf springs and fitted into notches formed in the locking plates of the lower container part and the upper container part to position and support the lower container part and the upper container part. The upper hook and the lower hook are vertically and horizontally symmetric.

3 Claims, 7 Drawing Sheets

BUCKLE FOR THIN PLATE STORAGE CONTAINER AND THIN PLATE STORAGE CONTAINER

CROSS-REFERENCE TO RELATED APPLICATION

This application claims, under 35 USC 119, priority of Japanese Patent Application No. 2006-95396 filed on Mar. 30, 2006.

BACKGROUND ART

The present invention relates to a buckle for a thin plate storage container used for storing, carrying and keeping a thin plate such as a semiconductor wafer, and a thin plate storage container using the buckle for the thin plate storage container.

A thin plate storage container for storing, carrying and keeping a few thin plates is generally known. In such a thin plate storage container, when the number of stored thin plates is small, the size thereof is wholly miniaturized and a main body and a cover are fixed to each other with an adhesive tape.

However, when the main body and the cover are fixed to each other with the adhesive tape like the above-described thin plate storage container, an adhesive surface may be adhered to several different positions and thus the main body and the cover must be accurately positioned and adhered to each other. To this end, it takes much time to adhere the adhesive tape and thus workability is bad. In addition, waste is generated.

SUMMARY OF THE INVENTION

The objective of the present invention is to address the above-described problems and to provide a buckle for a thin plate storage container and a thin plate storage container wherein lower and upper container parts are easily fixed together by the buckle. To this end, according to a first aspect of the present invention, there is provided a buckle for a thin plate storage container including a plate-shaped main body substantially configuring an entire shape of the buckle; an upper hook which is provided at an upper end of the main body and which has a groove engaged with a locking plate of an upper container part; a lower hook which is provided at a lower end of the main body and which has a groove engaged with a locking plate of a lower container part; spring mounting recesses formed in the upper and lower hooks; two leaf springs respectively fitted in the spring mounting recesses of the upper hook and the lower hook, wherein the two leaf springs have their longest dimension parallel to the upper and lower ends and to each other; and locking protrusions at the middle of the respective leaf springs and fitted into notches formed in the locking plates of the lower container part and the upper container part to position and support the lower container part and the upper container part, wherein the upper hook part and the lower hook part are vertically and horizontally symmetrical.

With the upper container part and the lower container part fitted together, the groove of the upper hook and the groove of the lower hook are fitted onto the locking plate of the upper container part and the locking plate of the lower container part, respectively, and thus the buckle for the thin plate storage container is engaged. At this time, the locking protrusions of the leaf springs are fitted into the notches in the locking plates of the lower container part and the upper container part, and the buckle for the thin plate storage container is positioned in and supported by the locking plates. Accordingly, the upper container part and the lower container part are fixed by the buckle.

In addition, since the upper hook and the lower hook are vertically and horizontally symmetrical, respectively, the buckle for the thin plate storage container need not be fitted in all directions and can be easily mounted.

In a first aspect of the present invention, horizontally symmetric grip recesses, which can be grasped by hand, are provided at opposing ends of the vertical center portion of the main body.

Thus, while the buckle is mounted on the upper and lower locking plates, the grip recesses may be grasped by hand.

According to a second aspect of the present invention, there is provided a thin plate storage container including a lower container part having an open end for receiving and storing a plurality of thin plates; an upper container part, with an open end, for covering the open end of the lower container part; and a buckle for fixing the lower container part and the upper container part together with the upper container part covering the opening of the lower container part, wherein the lower container part and the upper container part have the same shape and are interchangeable with each other, and locking plates, for engagement with the buckle, extending from the open ends of the lower container part and the upper container part, wherein the buckle for the thin plate storage container includes: a plate-shaped main body substantially configuring an entire shape of the buckle; an upper hook which is provided at an upper end of the main body and which has a groove for engagement with a locking plate of the upper container part; a lower hook which is provided at a lower end of the main body and which has a groove for engagement with a locking plate of the lower container part; spring mounting recesses formed in horizontal center positions of the upper hook and the lower hook; two leaf springs respectively mounted in the upper hook and the lower hook, each leaf spring having opposing ends fixed in recesses within one of the upper and lower hooks and extending between the fixed opposing ends in parallel with the upper and lower ends and with the other leaf spring; and locking protrusions at the middle of the leaf springs and fitted into notches formed in the locking plates of the lower container part and the upper container part to position and support the lower container part and the upper container part, wherein the upper hook and the lower hook are vertically and horizontally symmetrical.

A plurality of thin plates are stored in the lower container part, the upper container part is seated on the lower container part, and the upper hook and the lower hook of the buckle are engaged with the locking plates, thereby mounting the buckle for the thin plate storage container. At this time, the locking protrusions of the leaf springs are fitted into the notches of the locking plates of the lower container part and the upper container part and the buckle for the thin plate storage container is thereby positioned on and supported by the locking plates. Accordingly, the upper container part and the lower container part are fixed together by the buckle.

In addition, since the upper hook and the lower hook are vertically and horizontally symmetrical, respectively, the buckle for the thin plate storage container need not be fitted in all directions and can be easily mounted.

DESCRIPTION OF THE PREFERRED EMBODIMENT

Figure 1:
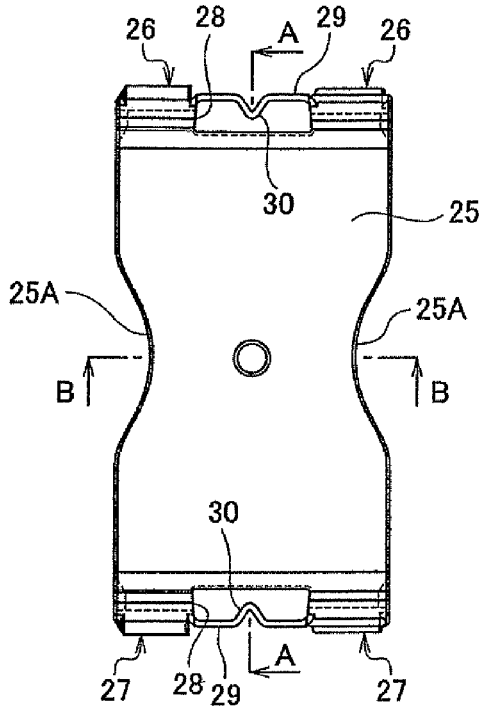
FIG. 1 is a front view of a buckle for a thin plate storage container according to an embodiment of the present invention.
Figure 2:
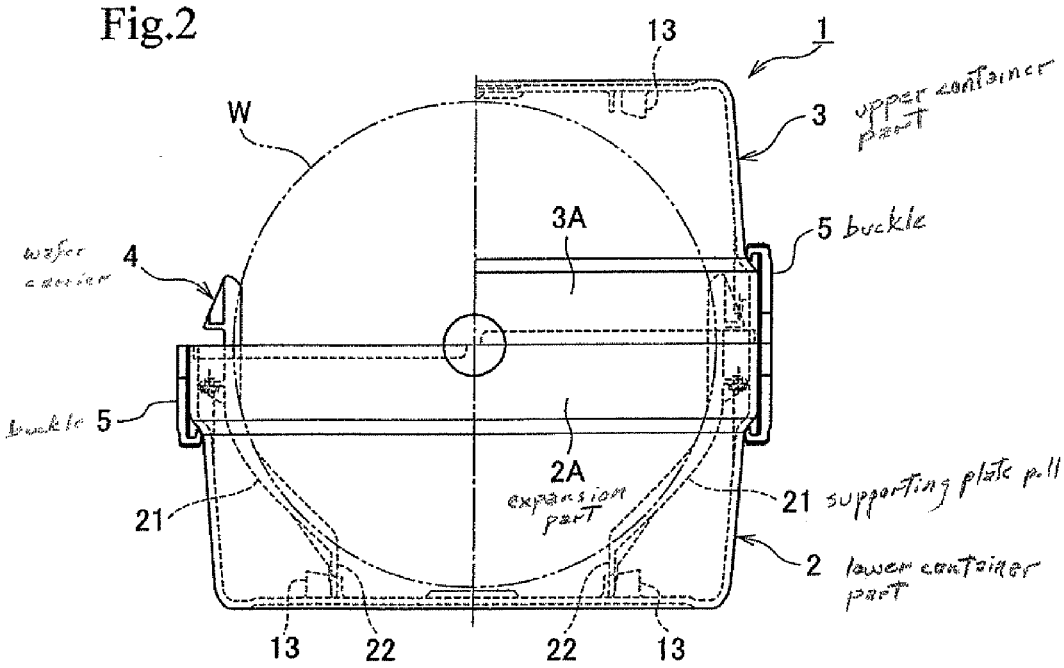
FIG. 2 is a partially cut-away front view of a thin plate storage container according to an embodiment of the present invention.

Hereinafter, an embodiment of the present invention will be described with reference to the attached drawings. A thin plate storage container according to the present invention is a container for storing, carrying and keeping a thin plate such as a semiconductor wafer, a magnetic recording medium disc, or an optical recording medium disc. In the present embodiment, for example, a thin plate storage container for storing a semiconductor wafer will be described.

A thin plate storage container 1, as shown in FIGS. 2 to 6, mainly includes a lower container part 2, an upper container part 3, a wafer carrier 4, and a buckle 5 for the thin plate storage container.

Figure 13:
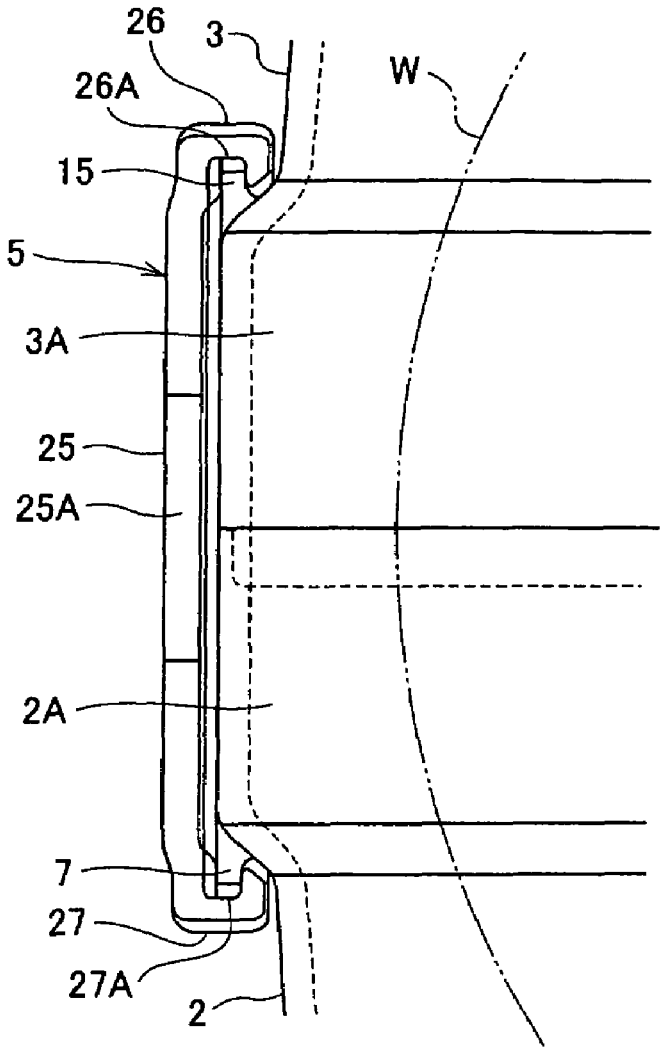
FIG. 13 is a side view of the thin plate storage container according to the present invention mounted on a locking plate.
Figure 14:
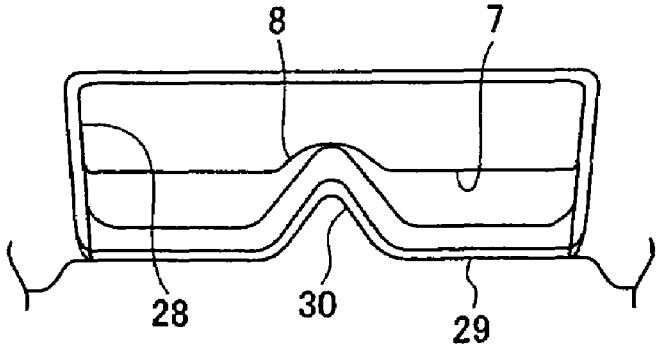
FIG. 14 is an enlarged view of a part of a leaf spring and the locking plate of the buckle for the thin plate storage container according to the present invention.

The lower container part 2 is a container for storing a plurality of semiconductor wafers W therein. The lower container part 2 is a deep container having a substantially rectangular plan shape. A flange portion 2A is expanded outward at the upper side of the lower container part 2. The flange portion 2A extends around the entire circumference of the upper side of the lower container part 2. Locking plates 7 (see FIGS. 13 and 14) are provided at the lower end of the flange portions 2A of the short sides (left and right sides of FIG. 6) of the lower container part 2. The locking plate 7 is a plate which extends downward from the lower end of the flange portion 2A and receives a lower hook 27 of the buckle 5. A notch 8 (see FIG. 14), which receives a locking protrusion 30 of the buckle 5, is formed in the center portion of the locking plate 7. The notch 8 has an arc concave shape such that the locking protrusion 30 of the buckle 5 is smoothly fitted there-into. By fitting the locking protrusion 30 of the buckle 5 into the notch 8, the buckle 5 is positioned and supported. In addition, the edges of the notch 8 are curved in an arc shape and the locking protrusion 30 slides on the locking plate 7 to be smoothly fitted into and to be smoothly taken out from the notch 8.

Figure 3:
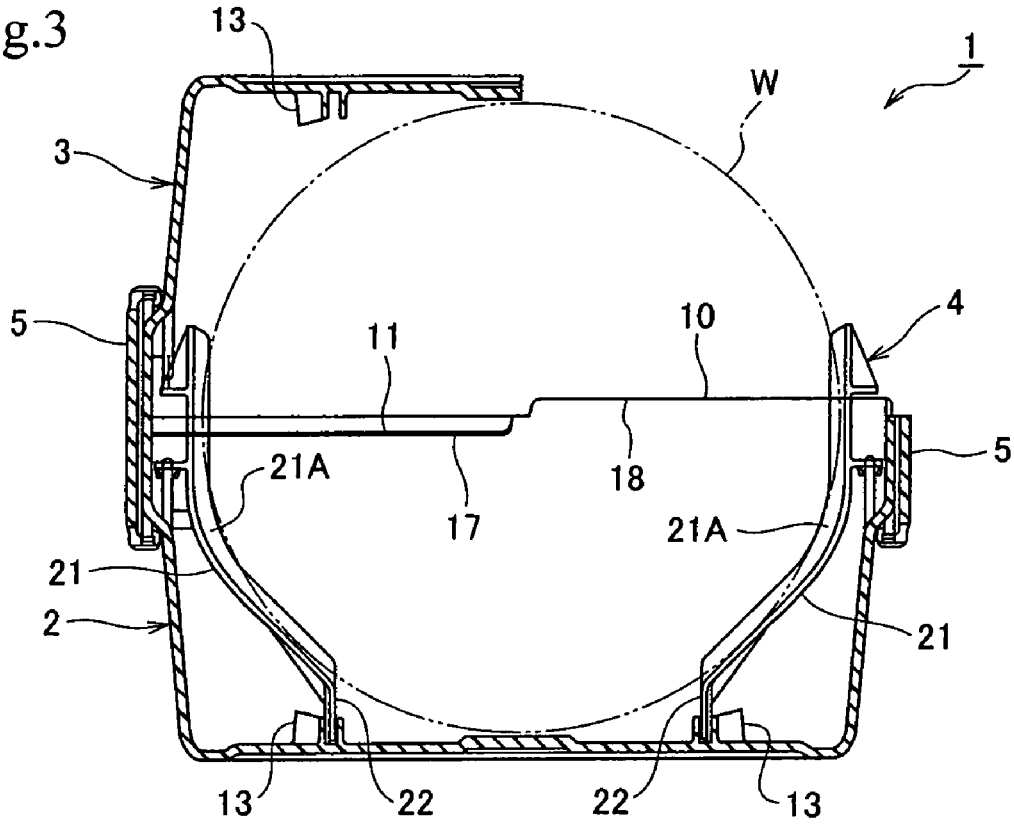
FIG. 3 is a partially cut-away front cross-sectional view of the thin plate storage container according to the embodiment of the present invention.
Figure 4:
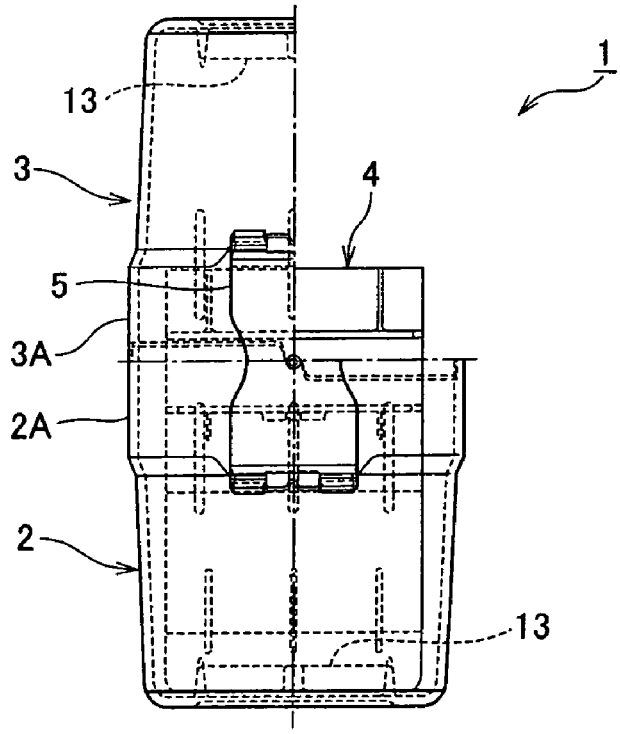
FIG. 4 is a partially cut-away side view of the thin plate storage container according to the embodiment of the present invention.
Figure 5:
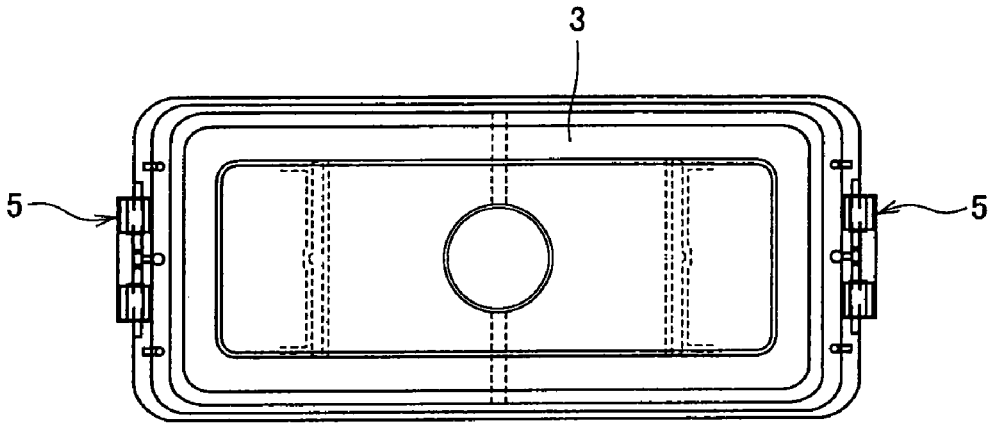
FIG. 5 is a plan view of the thin plate storage container according to the embodiment of the present invention.
Figure 6:
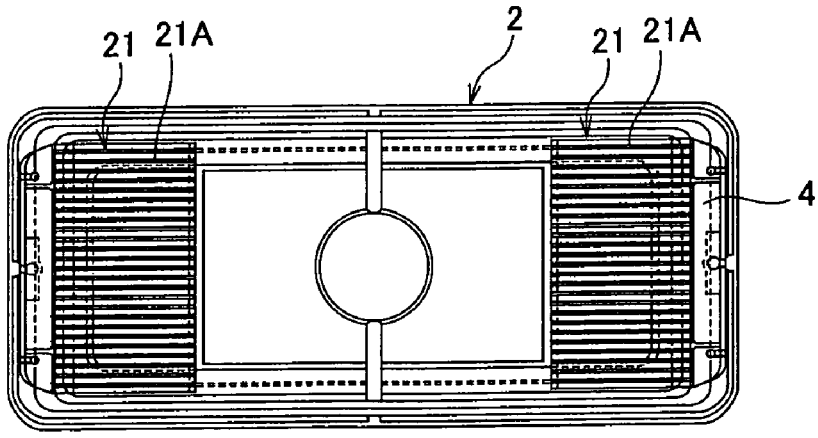
FIG. 6 is a plan view of the thin plate storage container according to the embodiment of the present invention with an upper container part removed.
Figure 7:
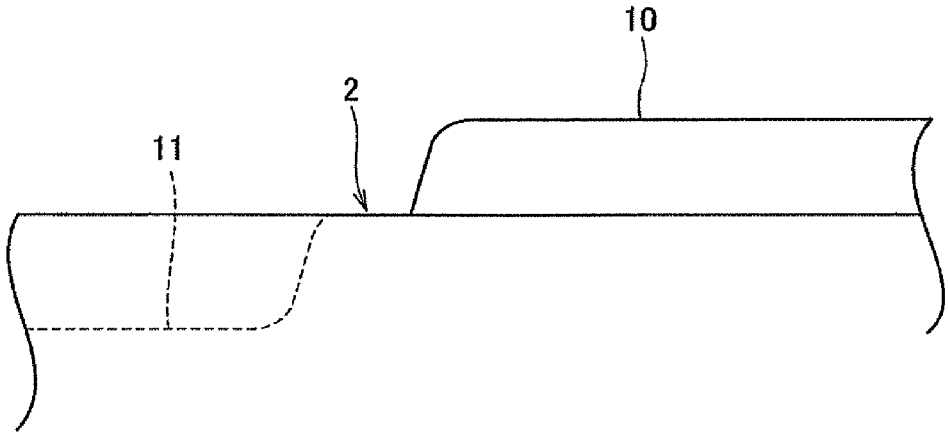
FIG. 7 is an enlarged front view of an upper end of a lower container part of the thin plate storage container according to the embodiment of the present invention.
Figure 8:
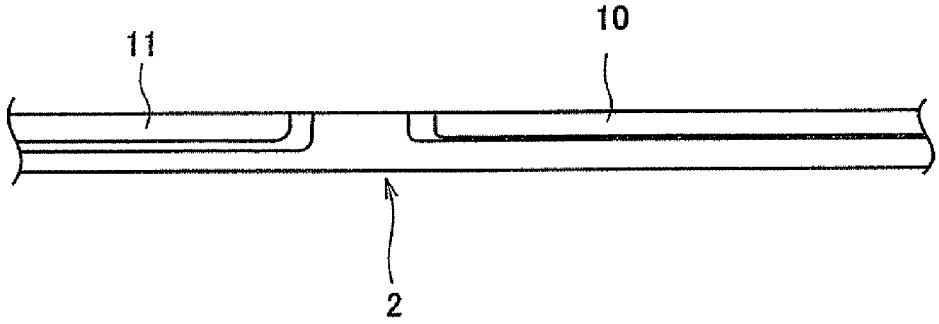
FIG. 8 is an enlarged plan view of the upper end of the lower container part of the thin plate storage container according to the embodiment of the present invention.
Figure 9:
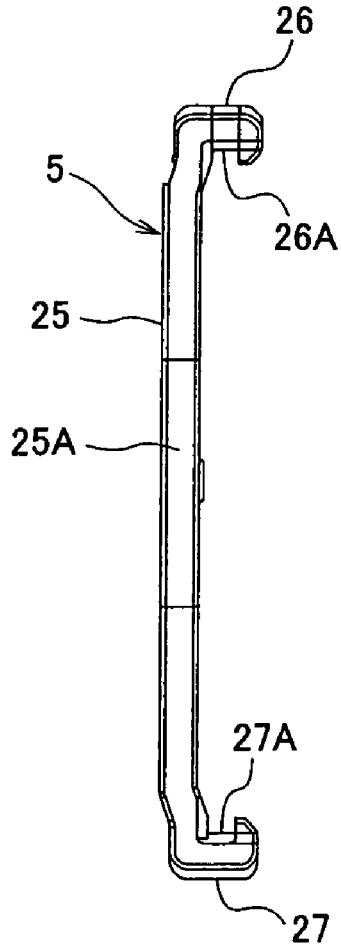
FIG. 9 is a side view of the buckle for the thin plate storage container according to the embodiment of the present invention.
Figure 10:
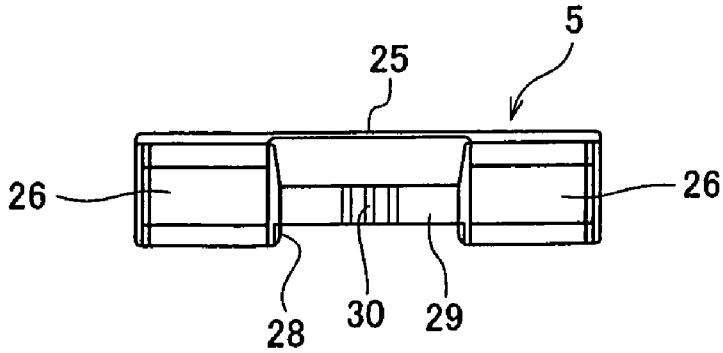
FIG. 10 is a plan view of the buckle for the thin plate storage container according to the present invention.
Figure 11:
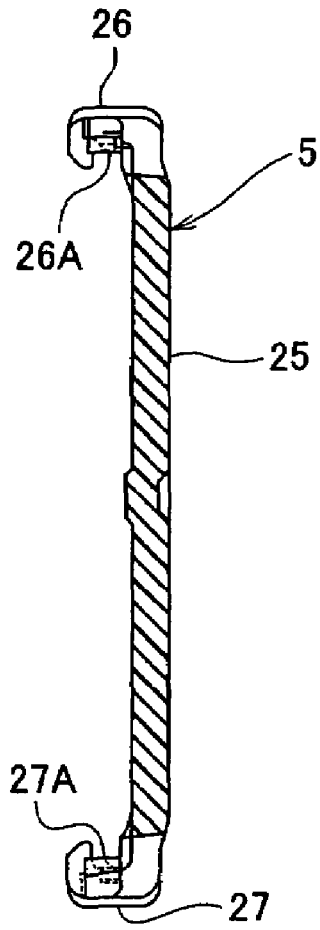
FIG. 11 is a cross-sectional view taken along line A-A of FIG. 1.
Figure 12:
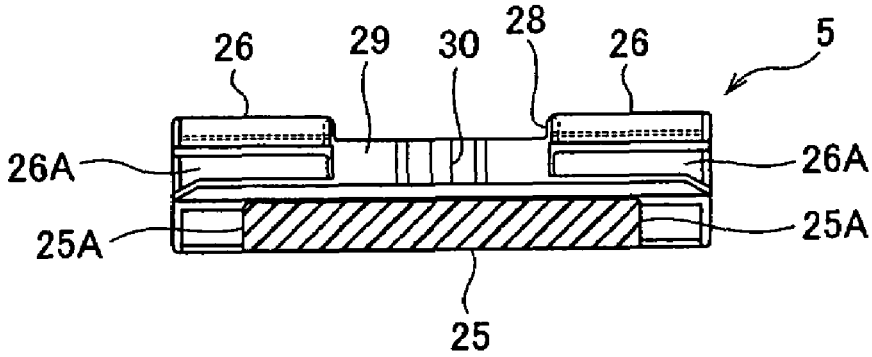
FIG. 12 is a cross-sectional view taken along line B-B of FIG. 1.

At the upper end of the lower container part 2, a raised ("convex") fitting ridge 10 extends along one half portion (right half portion of FIG. 3) of a longitudinal dimension of the long sides (upper and lower sides of FIG. 6) and a lower ("concave") fitting ridge 11 extends over the other half portion thereof (left half portion of FIG. 3). The convex fitting ridge 10 and the concave fitting ridge 11 are provided at both long sides. The convex fitting ridge 10 and the concave fitting ridge 11 have the same shape for mating with each other, as shown in FIGS. 7 and 8. The concave fitting ridge 18 and convex fitting ridge 17 of the upper container part 3, having the same shape as the concave fitting part 11 and the convex fitting ridge 10, are fitted into the convex fitting ridge 10 and the concave fitting ridge 11 of the lower container part 2, respectively, such that the upper container part 3 is positioned and supported on the lower container part 2.

Wafer carrier supporting grooves 13 for supporting the wafer carrier 4, which receive fitting legs 22 of the wafer carrier 4, are formed in the bottom of the lower container part 2, as shown in FIG. 3. The wafer carrier supporting grooves 13 are provided at two positions on the bottom of the lower container part 2 in correspondence with the position of the fitting legs 22 of the wafer carrier 4.

The upper container part 3 covers the upper (open) side of the lower container part 2 in which the semiconductor wafers W are stored. The upper container part 3 is a deep container having a substantially rectangular shape in plan view, similar to the lower container part 2. A flange portion 3A which is expanded outward is formed at the lower side of the upper container part 3, as shown in FIGS. 2 to 6. The flange portion 3A is formed around the entire circumference of the lower side of the upper container part 3. Locking plates 15 (see FIG. 13) are provided at the upper end of the flange portion 3A of the short sides of the upper container part 3. The locking plate 15 is a plate which extends upward from the upper end of the flange portion 3A and which receives an upper hook 26 of the buckle 5. A notch (not shown), which receives the locking protrusion 30 of the buckle 5, is formed in the center portion of the locking plate 15. The notch has the same shape as the notch 8 of the locking plate 7 of the lower container part 2.

In the lower end of the upper container part 3, as shown in FIG. 3, the convex fitting ridge 17 extends over one half of the longitudinal dimension of the long sides and the concave fitting ridge 18 extends over the other half portion thereof. The convex fitting ridge 17 and the concave fitting ridge 18 have the same shape as the convex fitting ridge 10 and the concave fitting ridge 11 of the lower container 2, respectively. Accordingly, the concave fitting ridge 18 and the convex fitting ridge 17 are fitted into the convex fitting ridge 10 and the concave fitting ridge 11 of the lower container part 2, respectively, such that the upper container part 3 covers the lower container part 2 while being positioned and supported by the lower container part 2.

Wafer carrier supporting grooves 13 for supporting the wafer carrier 4, which receive the fitting legs 22 of the wafer carrier 4, are formed in the bottom of the upper container part 3. The wafer carrier supporting grooves 13 are provided at two positions on the bottom of the upper container part 3 in correspondence with the positions of the fitting legs 22 of the wafer carrier 4.

Since the lower container part 2 and the upper container part 3 have the same shape, the wafer carrier 4 can be stored with either the lower container part 2 or the upper container part 3 disposed on the lower side.

The wafer carrier 4 mainly includes supporting plates 21 and the fitting legs 22. Each supporting plate 21 includes a plurality of supporting grooves 21A in which the semiconductor wafers W are fitted and supported. The supporting plates 21 face each other in a horizontally symmetrical manner (with the opening of the lower container part facing upward) and support the semiconductor wafers W from both sides. The fitting legs 22 extend downward from the lower ends of the supporting plates 21. Each fitting leg 22 is a member for supporting the whole wafer carrier 4. In addition, the fitting legs 22 fit into the wafer carrier supporting grooves 13 to position and support the wafer carrier 4 at an accurate position in the lower container part 2. Alternatively, the fitting legs 22 are also fitted into the upper container part 3. The fitting legs 22 are fitted into the wafer carrier supporting grooves 13 to position and support the wafer carrier 4 at an accurate position in the upper container part 3 when the wafer carrier 4 is stored in the upper container part 3 which is disposed at the lower side.

The buckle 5 for the thin plate storage container is a member for fixing together the lower container part 2 and the upper container part 3 in a state that the upper container part 3 is seated on the lower container part 2.

The buckle 5, as shown in FIGS. 1 and 9 to 12, includes a main body 25, an upper hook 26, a lower hook 27, a spring mounting part 28, a leaf spring 29, and the locking protrusions 30.

The main body 25 is a plate-shaped member which substantially configures the whole shape of the buckle 5. The main body 25 is made of a resilient synthetic resin. Specifically, the main body 25 is made of a flexible synthetic resin material having a strength for firmly supporting the lower container part 2 and the upper container part 3 when the upper container part 3 is seated on the lower container part 2. The kind of the synthetic resin is selected depending on the size and the weight of the lower container part 2 and the upper container part 3. Horizontally symmetrical recesses 25A, to be grasped by hand, are provided at opposing ends of the vertical center portion of the main body 25.

The upper hook 26 is formed on the upper end of the main body 25 and has a groove 26A which is engaged with (receives) the locking plate 15 of the upper container part 3. The groove 26A is formed in conformity with the shape of the upper end of the locking plate 15.

The lower hook 27 is formed on the lower end of the main body 25 and likewise has a groove 27A which is engaged with (receives) the locking plate 7 of the lower container part 2. The groove 27A is formed in conformity with the shape of the lower end of the locking plate 7.

The spring mounting part 28 is a notch (recess) in which the leaf spring 29 is fitted. The notch 28 is formed in the ends of the horizontal center portions of the upper hook 26 and the lower hook 27. Although, in the present embodiment, one notch 28 is provided in each of the upper hook 26 and the lower hook 27, two or more pairs of notches 28 may be provided depending on the number of the leaf springs 29 to be mounted.

The leaf spring 29 is a member which is resiliently in contact with the locking plate 7 or 15. The leaf spring 29 is fitted into the spring mounting part (notch) 28.

The locking protrusions 30 are fitted into the notches 8 formed in the locking plates 7 and 15 of the lower container part 2 and the upper container part 3 to position and support the buckle 5. The locking protrusions 30 are located at the middle (center) of the leaf springs 29, protruding toward the notches 8 of the locking plates 7 and 15 in a V shape. The V-shaped locking protrusion 30 is fitted into the arc-shaped notch 8 to position and support the buckle 5. Although only one locking protrusion 30 is provided in the leaf spring 29, two or more locking protrusions 30 may be provided. In the case where the buckle 5 must be prevented from being horizontally shifted, the number of the locking protrusions 30 is increased.

The upper hook 26 and the lower hook 27 are vertically symmetric. In addition, the upper hook 26 and the lower hook 27 are horizontally symmetric. Accordingly, the buckle 5 can be inserted and mounted in the locking plates 7 and 15 of the lower container part 2 and the upper container part 3 from any direction, left, right, top or bottom thereof.

[Operation]

The thin plate storage container 1 having the above-described configuration is used as follows:

First, the lower container part 2, the upper container part 3, and the wafer carrier 4 are prepared and the semiconductor wafers W are stored in the wafer carrier 4. Subsequently, the wafer carrier 4 is stored in either the lower container part 2 or the upper container part 3, with the fitting legs 22 of the wafer carrier 4 fitted into the wafer carrier supporting grooves 13.

Next, one of the lower container part 2 and the upper container part 3 is placed over the other one. Accordingly, the convex fitting ridge 10 and the concave fitting ridge 11 of the lower container part 2 are fitted into the concave fitting ridge 18 and the convex fitting ridge 17 of the upper container part 3, respectively.

Next, the buckle 5 is mounted on the locking plate 7 of the lower container part 2 and the locking plate 15 of the upper container part 3. Specifically, the upper hook part 26 is fitted onto the locking plate 7 or 15 disposed at the upper side and the lower hook part 27 is fitted onto the locking plate 15 or 7 disposed at the lower side while grasping by hand the concave part 25A of the buckle 5, and the buckle is slid to the center position of the locking plates 7 and 15.

Accordingly, the locking protrusion 30 of the leaf spring 29 is slid on the locking plates 7 and 15 and fitted into the notch 8 to position and support the buckle 5. At this time, when the buckle 5 is fitted onto the locking plates 7 and 15, the buckle 5 need not be fitted in all directions and the upper hook part 26 and the lower hook part 27 of the buckle 5 are appropriately fitted into any one of the locking plates 7 and 15 of the lower container part 2 and the upper container part 3.

When the semiconductor wafers W are taken out from the thin plate storage container 1, the buckle 5 is shifted to force the locking protrusion 30 from the notch 8.

Next, the upper container part 3 or the lower container part 2 located at the upper side is detached and the wafer carrier 4 stored inside is taken out. Then, the semiconductor wafers W in the wafer carrier 4 are taken out for processing.

[Effect]

Accordingly, the thin plate storage container 1 has the following effects.

When the buckle 5 is mounted on the locking plates 7 and 15 of the lower container part 2 and the upper container part 3, the locking protrusions 30 of the leaf springs 29 are fitted into the notches 8 of the locking plates 7 and 15, the buckle 5 is positioned and supported in the locking plates 7 and 15, and the buckle 5 thereby fixes the lower container part 2 and the upper container part 3. Therefore, it is possible to easily fix the lower container part 2 and the upper container part 3.

In addition, since the buckle 5 is symmetric horizontally and vertically and need not be fitted in all directions, it is possible to easily mount the buckle and to easily fix the lower container part and the upper container part together.

What is claimed is:

1. A buckle for a thin plate storage container having upper and lower parts, with mating open ends, comprising:

a plate-shaped main body substantially configuring an entire shape of the buckle;

an upper hook which is provided at an upper end of the main body, which has an upper groove for sliding engagement with a free distal end of a locking plate on the upper container part and seated within the upper groove, and which hooks over the free distal end of the locking plate seated within the upper groove;

a lower hook which is provided at a lower end of the main body, which has a lower groove for sliding engagement with a free distal end of a locking plate on the lower container part and seated within the lower groove, and which hooks over the free distal end of the locking plate seated within the lower groove;

spring mounting recesses formed in center positions of the upper hook and the lower hook;

two separate leaf springs respectively fitted in the spring mounting recesses of the upper hook and the lower hook, wherein a first of the two leaf springs has opposing ends fixed in the spring mounting recesses within the upper hook and a second of the two leaf springs has opposing ends fixed in the spring mounting recesses of the lower hook, and wherein the two leaf springs have their longest dimension parallel to the upper and lower ends and to each other; and locking protrusions at the middle of the respective leaf springs for fitting into notches formed in the locking plates of the lower container part and the upper container part.

2. A thin plate storage container comprising:

a lower container part having an open end for receiving and storing a plurality of thin plates;

an upper container part, with an open end, for covering the open end of the lower container part;

a buckle for the thin plate storage container for fixing the lower container part and the upper container part together with the upper container part covering the opening of the lower container part; and locking plates, for engagement with the buckle, each locking plate extending, from an end fixed to the lower container part or the upper container part, away from the open ends of the lower container part and the upper container part, to an edge at a free distal end, wherein the buckle for the thin plate storage container includes:

a plate-shaped main body substantially configuring an entire shape of the buckle;

an upper hook which is provided at an upper end of the main body and which has a first groove for sliding engagement with a locking plate of the upper container part seated within the first groove, whereby the upper hook is hooked over the free distal end of the locking plate seated within the first groove;

a lower hook which is provided at a lower end of the main body and which has a second groove for sliding engagement with a locking plate of the lower container part seated within the second groove, whereby the lower hook is hooked over the free distal end of the locking plate seated within the second groove;

spring mounting recesses formed in center positions of the upper hook and the lower hook;

two separate leaf springs respectively mounted in the upper hook and the lower hook, wherein a first of the two leaf springs has opposing ends fixed in recesses within the upper hook and a second of the two leaf springs has opposing ends fixed in recesses within the lower hook, each of the two leaf springs having its longest dimension extending between its fixed opposing ends in parallel with the upper and lower ends and with the other leaf spring; and locking protrusions at the middle of the respective leaf springs and fitted into notches formed in the edges of the free distal ends of the locking plates of the lower container part and the upper container part, and wherein the upper hook and the lower hook slide on the locking plates to release the locking plates; and the upper hook and the lower hook slide on the locking plates, in parallel with the edges of the locking plates to resiliently fit the locking protrusions of the leaf springs into the notches of the locking plates to position and support the upper container part on the lower container part.

3. The thin plate storage container according to claim 2 wherein the lower container part and the upper container part have the same shape and are interchangeable with each other.

* * * * *

UNITED STATES PATENT AND TRADEMARK OFFICE

CERTIFICATE OF CORRECTION

PATENT NO. : 7,631,778 B2
APPLICATION NO. : 11/395544
DATED : December 15, 2009
INVENTOR(S) : Seiji Yoshiyama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 731 days.

Signed and Sealed this

Twenty-first Day of December, 2010

David J. Kappos

David J. Kappos
*Director of the United States Patent and Trademark Office*